US008167713B2

(12) United States Patent
Allen et al.

(10) Patent No.: US 8,167,713 B2
(45) Date of Patent: May 1, 2012

(54) WAGERING GAME DIGITAL REPRESENTATIVE

(75) Inventors: Jeffrey L. Allen, Naperville, IL (US); Mark B. Gagner, West Chicago, IL (US); Damon E. Gura, Chicago, IL (US); James S. Halprin, Chicago, IL (US); Jeremy M. Hornik, Chicago, IL (US); Joel R. Jaffe, Glenview, IL (US); John M. Koszarek, Chicago, IL (US)

(73) Assignee: WMS Gaming, Inc., Waukegan, IL (US)

( * ) Notice: Subject to any disclaimer, the term of this patent is extended or adjusted under 35 U.S.C. 154(b) by 0 days.

(21) Appl. No.: 13/057,294

(22) PCT Filed: Aug. 4, 2009

(86) PCT No.: PCT/US2009/052769

§ 371 (c)(1),
(2), (4) Date: Feb. 3, 2011

(87) PCT Pub. No.: WO2010/017250

PCT Pub. Date: Feb. 11, 2010

(65) Prior Publication Data

US 2011/0143841 A1 Jun. 16, 2011

Related U.S. Application Data

(60) Provisional application No. 61/086,310, filed on Aug. 5, 2008.

(51) Int. Cl.
*A63F 9/24* (2006.01)

(52) U.S. Cl. ..... 463/29

(58) Field of Classification Search ..... 463/16–20, 463/25–29
See application file for complete search history.

(56) References Cited

U.S. PATENT DOCUMENTS

2007/0112714 A1 5/2007 Fairweather
2008/0076519 A1 3/2008 Chim

FOREIGN PATENT DOCUMENTS

WO WO2010017250 2/2010

OTHER PUBLICATIONS

"PCT Application No. PCT/US09/52769 International Preliminary Report on Patentability", Feb. 17, 2011 , 13 pages.
"PCT Application No. PCT/US09/52769 International Search Report", Sep. 17, 2009 , 8 pages.

*Primary Examiner* — Omkar Deodhar
(74) *Attorney, Agent, or Firm* — DeLizio Gilliam, PLLC

(57) ABSTRACT

A wagering game developer can support an online wager gaming community and provide digital representatives to members to enhance real-life wager gaming experience. A digital representative of a wagering game player can be imported from a remote store associated with an online wager gaming community. Data associated with the digital representative can also be imported. Wagering game activity of the wagering game player at one or more electronic wagering game machines in a wagering game establishment is determined. One or more digital representative data updates for the digital representative are determined based, at least in part, on the determined wagering game activity of the wagering game player. The one or more digital representative updates are applied to the data associated with the digital representative. The digital representative and the updated data associated with the digital representative are exported.

22 Claims, 10 Drawing Sheets

WAGERING GAME DIGITAL REPRESENTATIVE

RELATED APPLICATIONS

This application claims the priority benefit of U.S. Provisional Application Ser. No. 61/086,310 filed Aug. 5, 2008.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2009, WMS Gaming, Inc.

FIELD

Embodiments of the inventive subject matter relate generally to wagering game systems, and more particularly to modifying digital representatives of wagering game players based on wagering game activity data.

BACKGROUND

Various companies offer interactive online communities. A person interacts with a given online community with a digital representative of the person (e.g., a digital pet, a digital avatar, etc.). The interaction can involve maintaining the digital representative (e.g., feeding a digital pet, purchasing accessories to adorn a digital avatar). This interaction provides entertainment that draws numerous people to the corresponding website(s).

SUMMARY

In some embodiments, a method comprises importing a digital representative of a wagering game player from a remote store associated with an online wager gaming community, and data associated with the digital representative; determining wagering game activity of the wagering game player at one or more electronic wagering game machines in a wagering game establishment; determining one or more digital representative data updates for the digital representative based, at least in part, on the determined wagering game activity of the wagering game player; applying the one or more digital representative updates to the data associated with the digital representative; and exporting the digital representative and the updated data associated with the digital representative.

In some embodiments, said digital representative comprises graphical data for rendering the digital representative.

In some embodiments, the digital representative comprises code that, when executed, causes said determining the one or more digital representative data updates for the digital representative.

In some embodiments, said applying the one or more digital representative updates to the data associated with the digital representative comprises modifying the data associated with the digital representative to reference executable code that implements the one or more digital representative updates, wherein the one or more digital representative updates comprise at least one of reward points, enhancements, and digital representative augmentations.

In some embodiments, said determining the wagering game activity comprises receiving indications of the wagering game activity over a network from the one or more electronic wagering game machines.

In some embodiments, the method further comprises the digital representative propagating the indications of the wagering game activity to one or more widgets, wherein the one or more widgets are at least one of referenced by the digital representative and nested within the digital representative.

In some embodiments, said data associated with the digital representative comprises data that indicates one or more of attributes, properties, reward points, and enhancements.

In some embodiments, the method further comprises detecting activation of an account in the wagering game establishment for the wagering game player, wherein said importing is responsive to the said detecting.

In some embodiments, said exporting is to one or more servers that support the online wager gaming community.

In some embodiments, a method comprises instantiating a digital representative game instance that renders interaction among a plurality of digital representatives of wagering game players in a wagering game establishment, wherein the plurality of digital representatives are associated with one or more online wager gaming communities; monitoring wagering game activity of the wagering game players in the wagering game establishment; influencing the game instance with the wagering game activity of the wagering game players; and generating one or more indications of a result of the digital representative game instance for application to data associated with at least a winning one of the plurality of digital representatives.

In some embodiments, said monitoring comprises spawning a process that listens for wagering game activity communications from the plurality of wagering game machines.

In some embodiments, said influencing the game instance with the wagering game activity comprises determining a game input based, at least in part, on a wagering game activity; and in putting the determined game input into logic for the game instance.

In some embodiments, said determining the game input comprises at least one of deriving the game input with an expression and the wagering game activity and looking up the game input based, at least in part, on the wagering game activity.

In some embodiments, one or more machine-readable media encoded with instructions, which when executed by a set of one or more processors, causes the set of one or more processors to perform operations that comprise importing a digital representative of a wagering game player from a remote store associated with an online wager gaming community, and data associated with the digital representative; determining wagering game activity of the wagering game player at one or more electronic wagering game machines in a wagering game establishment; determining one or more digital representative data updates for the digital representative based, at least in part, on the determined wagering game activity of the wagering game player; applying the one or more digital representative updates to the data associated with the digital representative; and exporting the digital representative and the updated data associated with the digital representative.

In some embodiments, said digital representative comprises graphical data for rendering the digital representative.

In some embodiments, the digital representative comprises the instructions to perform at least one of the operations of determining the wagering game activity and applying the one or more digital representative updates.

In some embodiments, said data associated with the digital representative comprises data that indicates one or more of attributes, properties, reward points, and enhancements.

In some embodiments, the operations further comprise detecting activation of an account in the wagering game establishment for the wagering game player, wherein said importing is responsive to the said detecting.

In some embodiments, said exporting operation exports to one or more servers that support the online wager gaming community.

In some embodiments, one or more machine-readable media encoded with instructions, which when executed by a set of one or more processors, causes the set of one or more processors to perform operations that comprise instantiating a digital representative game instance that renders interaction among a plurality of digital representatives of wagering game players in a wagering game establishment, wherein the plurality of digital representatives are associated with one or more online wager gaming communities; monitoring wagering game activity of the wagering game players in the wagering game establishment; influencing the game instance with the wagering game activity of the wagering game players; and generating one or more indications of a result of the digital representative game instance for application to data associated with at least a winning one of the plurality of digital representatives.

In some embodiments, said monitoring operation comprises spawning a process that listens for wagering game activity communications from the plurality of wagering game machines.

In some embodiments, said operation of influencing the game instance with the wagering game activity comprises determining a game input based, at least in part, on a wagering game activity; and in putting the determined game input into logic for the game instance.

In some embodiments, said operation of determining the game input comprises at least one of deriving the game input with an expression and the wagering game activity and looking up the game input based, at least in part, on the wagering game activity.

In some embodiments, an apparatus comprises a network interface; means for obtaining a digital representative of a wagering game player from a remote source associated with an online wager gaming community, and data associated with the digital representative; and means for modifying the data associated with the digital representative based, at least in part, on wagering game activity of the wagering game player in a wagering game establishment.

In some embodiments, the apparatus further comprises means for exporting the modified data associated with the digital representative to one or more servers that support the online wager gaming community.

In some embodiments, the apparatus further comprises means for instantiating a digital representative game that incorporates digital representatives and wagering game activity of players associated with the digital representatives.

In some embodiments, an apparatus comprises a set of one or more processors; a network interface; and a digital representative modifier operable to, determine wagering game activity of a player at an electronic wagering game machine, determine one or more updates to be applied to a digital representative based, at least in part, on the wagering game activity, wherein the digital representative is associated with an online wager gaming community, and apply the one or more updates to the digital representative.

In some embodiments, the apparatus further comprises a digital representative importer coupled with the digital representative modifier, the digital representative importer operable to obtain a digital representative and data associated with the digital representative from a remote source associated with the online wager gaming community.

In some embodiments, the apparatus further comprises a digital representative exporter coupled with the digital representative modifier, the digital representative exporter operable to export the digital representative with the applied one or more updates to the online wager gaming community.

BRIEF DESCRIPTION OF THE FIGURES

Embodiments of the invention are illustrated in the Figures of the accompanying drawings in which.

DESCRIPTION OF THE EMBODIMENTS

The description that follows includes exemplary systems, methods, techniques, instruction sequences and computer program products that embody techniques of the present inventive subject matter. However, it is understood that the described embodiments may be practiced without these specific details. For instance, embodiments are described with reference to updating digital representative data based on wagering game activity. Embodiments can also influence wagering games based on digital representative data. For example, any one of a reputation value, popularity value, power value, etc., indicated by the digital representative data can be used to influence a wagering game (e.g., the reels, as a multiplier, etc.). In other instances, well-known instruction instances, protocols, structures and techniques have not been shown in detail in order not to obfuscate the description.

The electronic wagering game industry can leverage the popularity of online social communities and digital representatives. The electronic wagering game industry can support online social communities (e.g., an online wager gaming community) and provide digital representatives to members of the communities. electronic wagering game industry (e.g., service provider, wagering game developer, wagering game machine manufacturer, etc.) can extend the digital representatives to be affected by real-life wagering game activity of corresponding players in wagering game establishments, thus creating a relationship between a player's activity in the online community and real-life wagering game establishments. While at a wagering game establishment, a player can import a digital representative from his/her online wager gaming community. Playing wagering games in the wagering game establishment can generate data that can be used to affect presentation of the digital representative (e.g., appearance, power level, accessories, etc.).

Figure 1:
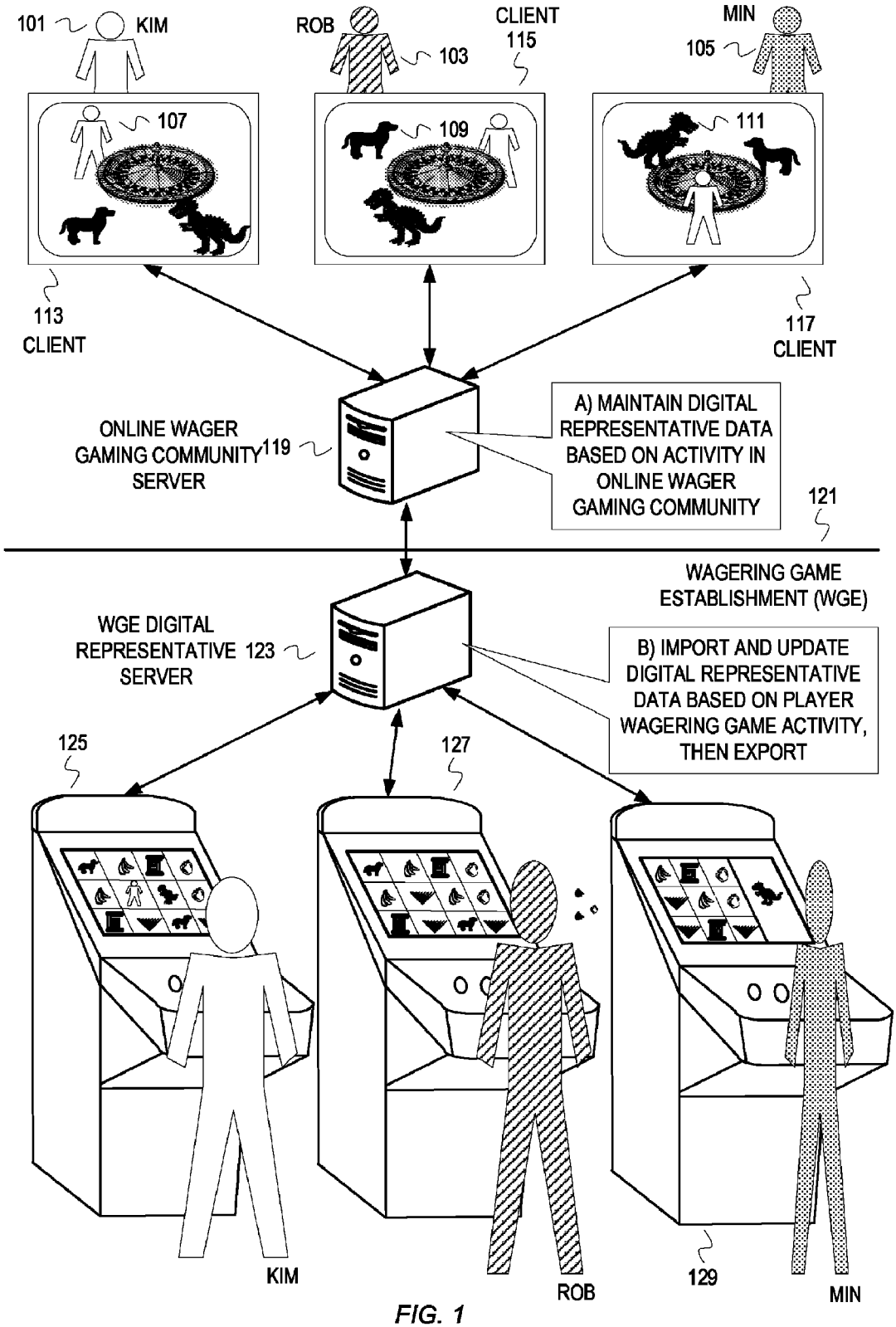
FIG. 1 depicts a conceptual diagram of an example system that updates digital representative data based on a player's wagering game activity.

FIG. 1 depicts a conceptual diagram of an example system that updates digital representative data based on a player's wagering game activity. Wagering game players Kim 101, Rob 103, and Min 105 participate in an online social wager gaming community at least partially supported with an online wager gaming community server 119. The server 119 hosts data and/or processes for online wagering games, not necessarily involving actual money, played by members of the community. The players 101, 103, and 105 can play any one of a variety of online wagering games provided by the server 119 and/or other servers with other members, themselves, and/or automated digital representatives.

The players 101, 103, and 105 respectively have digital representatives 107, 109, and 111. Examples of a digital representative include a graphical representation (e.g., still image, animated image, etc.) of a player, a graphical representation of an animal, a graphical representation of an automobile, a graphical representation of a building, etc. The digital representatives 107, 109, and 111 are a human avatar, a dog, and a dinosaur. In FIG. 1, the players 101, 103, and 105 are represented by their respective digital representatives 107, 109, and 111 at an online roulette game. At a stage A, the online wager gaming community server 119 maintains the digital representatives and associated data based, at least in part, on activity by members in the online wager gaming community. Each of clients 113, 115, and 117 process data received from the server 119 to render a scene of the roulette game for the players 101, 103, and 105, respectively. Of course, the community is not necessarily presented as a virtual reality community. For example, the digital representatives could be listed in a side pane with numerical results displayed for an online roulette game.

The digital representatives 107, 109, and 111 may be user created, provided by one or more wagering game developers, provided by a third party service provider, etc. Participation in the online social wager gaming community can impact the digital representatives 107, 109, and 111. For instance, Kim's good fortune in the online wagering games available in the community may generate rewards (e.g., credits, points, etc.) to trade for accessories and/or adornments for the avatar 107 or reward the accessories outright for wins. As with the digital representatives, data for indicating and/or rendering the accessories or adornments ("digital representative data") may be user generated, created and controlled by a wagering game developer, etc. Of course, digital representative data is not limited to data for indicating and/or rendering rewards. Digital representative data can be data for indicating and/or rendering modifications to a digital representative (e.g., different color hair or fur, bigger teeth on a dinosaur, more muscular wrestler avatar, etc.). In addition, digital representative data is not limited to data that affects visual aspects of a digital representative. For instance, digital representative data may indicate greater horsepower for an automobile digital representative, degree of agility of an animal digital representative, etc. Furthermore, digital representative data is not limited to data that positively impacts a digital representative. If Rob loses frequently or participates infrequently, then digital representative data can be associated with the digital representative 109 to denigrate the digital representative 109. For example, the dog 109 can be made to appear smaller, shaggy, or even a different breed (e.g., using a different graphical representation).

When the players 101, 103, and 105 go to play in a wagering game establishment 121, their digital representatives 107, 109, and 111 can be imported into the wagering game establishment 121. In FIG. 1, Kim, Rob, and Min are playing at electronic wagering game machines 125, 127, and 129, respectively. At a stage B, a wagering game establishment digital representative server 123 imports the digital representatives 107, 109, and 111, as well as associated digital representative data. The server 123 deploys the digital representatives 107, 109, and 111 to the respective electronic wagering game machines 125, 127, and 129.

Each of the electronic wagering game machines 125, 127, and 129 uses the digital representatives differently. The differences can be based on machine configuration, game configuration, player preferences, etc. The electronic wagering game machine 129 displays the digital representative 111 in a side panel adjacent to the wagering game graphics. The electronic wagering game machine 129 can animate the digital representative 111 responsive to game play, can randomly animate the digital representative 111, can display a still image of the digital representative 111, etc. The electronic wagering game machine 127 utilizes the digital representative 109 as an icon for a tile in a video slot game. The electronic wagering game machine 125 uses all of the digital representatives 107, 109 and 111 for tiles in a video slot game (e.g., Kim, Rob, and Min register as a social group with the wagering game establishment).

Although FIG. 1 depicts digital representatives participating in one game, embodiments are not so limited. A digital representative can participate in multiple, concurrent wagering games. Embodiments can maintain separate states for each instance of a digital representative, and allow the user to select certain of those states to persist. Embodiments can also merge or synchronize states of the digital representative instances. In addition, embodiments can maintain a single state of the digital representative across the multiple concurrent, wagering games. For example, displayed instances of a digital representative can be updated across the multiple wagering games to reflect activity and/or events at one of the wagering games (e.g., updating digital representative instances to reflect mood, updating digital representative instances to depict newly won power points or accessories, etc.).

The wagering game activity of Kim, Rob, and Min can generate updates to be applied to the digital representatives 107, 109, and 111. For instance, Kim winning a certain amount of money or hitting certain tile combinations can lead to points being awarded and associated with the digital representative 107. Kim can then use the points to enhance the digital representative 107.

Figure 2:
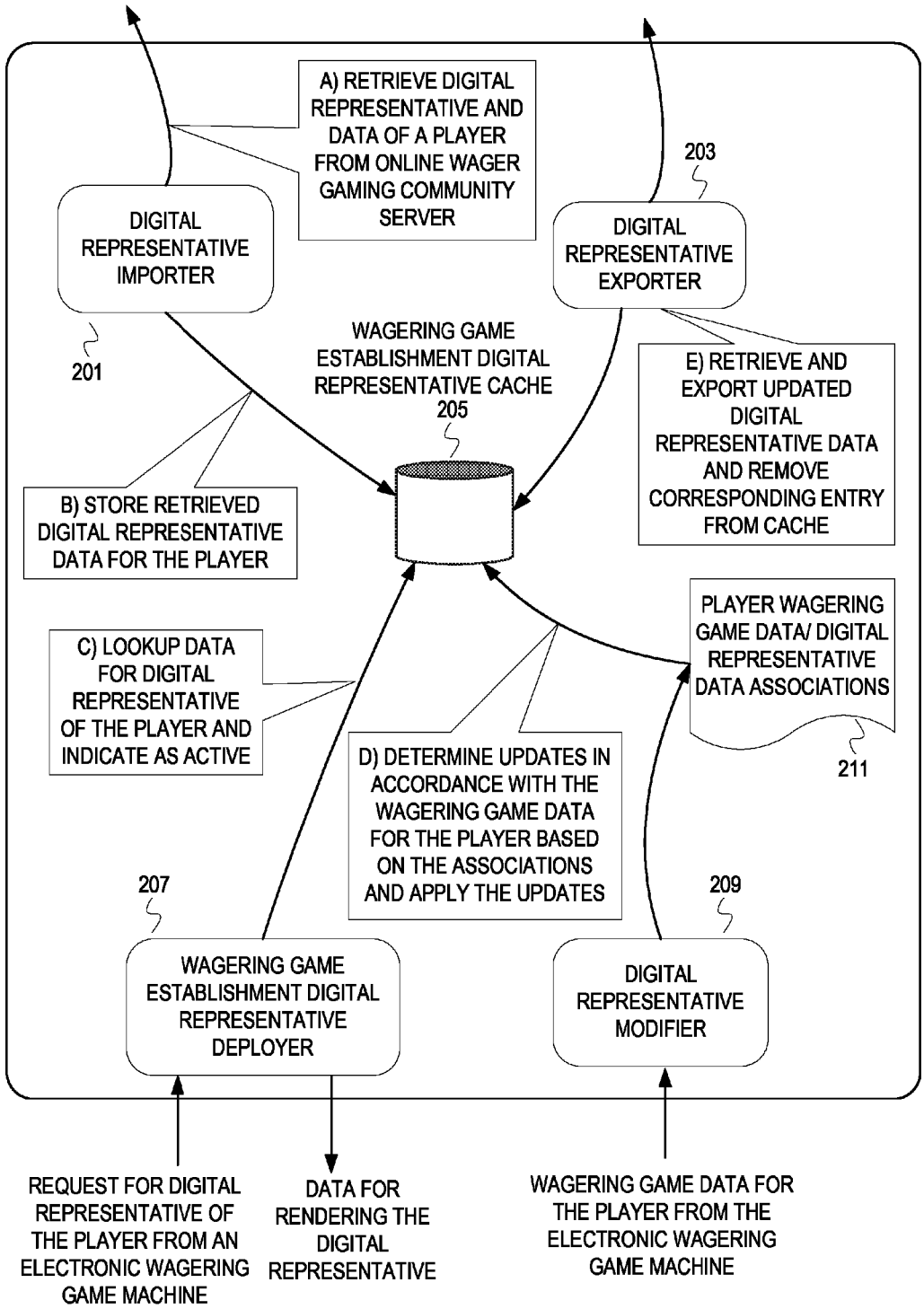
FIG. 2 depicts an example conceptual diagram of a wagering game establishment digital representative module.

FIG. 2 depicts an example conceptual diagram of a wagering game establishment digital representative module. An example wagering game establishment digital representative module comprises a digital representative importer 201, a wagering game establishment digital representative cache 205, a wagering game establishment digital representative deployer 207, a digital representative modifier 209, and a digital representative exporter 203.

The digital representative importer 201 obtains a digital representative and associated data for a wagering game establishment. At a stage A, the digital representative importer 201 retrieves a player's digital representative and associated digital representative data from an online wager gaming community server. The digital representative importer 201 imports the digital representative and associated digital representative data into a wagering game establishment digital representative cache 205 at a stage B. Importing can comprise operations to create an entry and write the retrieved digital representative and data into the created entry, populate an existing entry, etc. Although referred to as a cache, the cache 205 can be implemented as memory, network storage, a compact disk, a hard disk, etc.

The wagering game establishment digital representative deployer 207 deploys digital representatives, and perhaps associated data, responsive to requests. The wagering game establishment digital representative deployer 207 receives a request for the digital representative of the player from an electronic wagering game machine. At a stage C, the wagering game establishment digital representative deployer 207 performs a lookup in the wagering game establishment digital representative cache 205 based on the request. The deployer 207 also updates the appropriate entry in the cache 205 to indicate the digital representative as active. The deployer 207 transmits data to the electronic wagering game machine that allows the electronic wagering game machine to render the digital representative, with or without any enhancements, adornments, or modifications.

The digital representative modifier 209 determines updates to be applied to digital representatives based on wagering game activity of players in a wagering game establishment. The digital representative modifier 209 receives wagering game data for the player from the electronic wagering game machine. At a stage D, the digital representative modifier 209 determines updates to be applied to the digital representative in accordance with the wagering game data and a structure 211 that associates wagering game data with digital representative data. The association between wagering game data and digital representative data can be implemented differently. For instance, the structure 211 can indicate expressions for computing reward points based on one or more of money won, money wagered, number of wins, etc. As another example, the structure 211 can indicate unlocked digital representatives if a player plays 5 different games by the same wagering game developer or wagers a thousand times in the same wagering game. After determining the updates, the digital representative modifier 209 applies the updates to the one or more relevant entries in the wagering game establishment digital representative cache 205.

The digital representative exporter 203 exports updates to an appropriate one or more online wager gaming community servers. At a stage E, the digital representative exporter 203 retrieves updated digital representative data and exports it from the wagering game establishment to an appropriate wager gaming community. The digital representative exporter 203 can export based on a schedule, based on a travel itinerary for the player, based on checkout from a hotel, based on a request from an online wager gaming community, etc. The digital representative exporter 203 can determine the appropriate destination for the digital representative data update(s) from the entry, configuration, default indication, etc. At the stage E, the digital representative exporter 203 also removes the entry for the exported digital representative data from the cache 205. It is not necessary, however, to flush entries from the wagering game establishment. A wagering game establishment and/or wagering game creator/developer can choose to compress digital representative data when not active, archive digital representative data, maintain the digital representative data and mark it as inactive, etc.

Although FIG. 2 depicts an example of wagering game data being maintained separately from the digital representatives, embodiments are not so limited. Embodiments can implement digital representatives with data that associates the digital representative with one or more wagering games, and with functionality that corresponds to the associated one or more wagering games. For example, a digital representative can comprise code that indicates a set of rules and attributes that determine particular responses to wagering game events, and that indicates operations to implement the particular responses. A digital representative can be associated with different and/or new code that alters the behavior and/or appearance of the digital representative over time. For example, a combination of various "power-up" code units and a code unit for a particular accessory can result in behavior and/or appearance of the digital representative unique to that combination. Embodiments can modify the digital representative to reference such code units, incorporate such code units, etc.

It should be understood that stages are used throughout this description to aid in illustrating embodiments and should not be used to limit embodiments or claim scope. Events and/or operations that are depicted as occurring at different stages can occur in a different order, occur differently, etc. Further, the actors depicted in these figures are examples and can vary with embodiments. For instance, a single unit or module can perform the operations depicted as being performed by the deployer 207 and the modifier 209. Example flowcharts are provided to depict operations without assuming operations can only be performed by particular actors.

Figure 3:
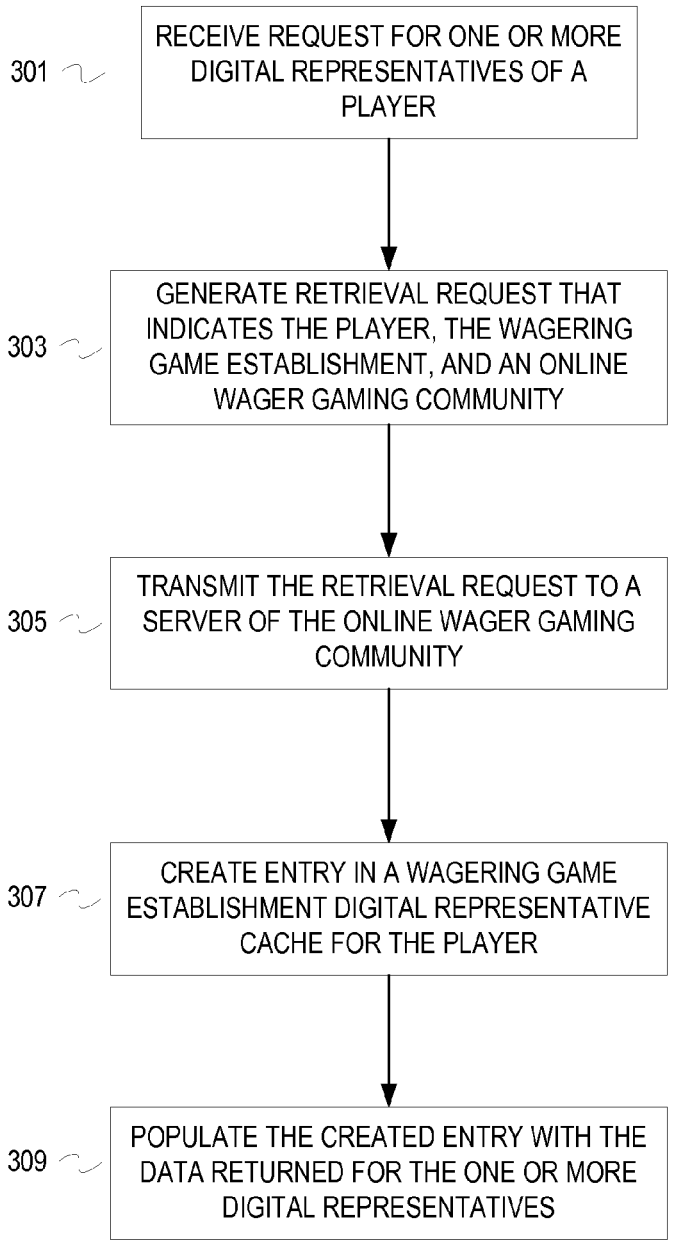
FIG. 3 depicts an example flowchart of operations for importing digital representative data into a wagering game establishment.

FIG. 3 depicts an example flowchart of operations for importing digital representative data into a wagering game establishment. At block 301, a request is received for one or more digital representatives of a player. For instance, a player with an account logs into an electronic wagering game machine to play. As another example, the request is generated when a player checks into a hotel.

At block 303, a retrieval request that indicates the player, the wagering game establishment, and an online wager gaming community is generated. An indication of the wager gaming community can be configured into the system, determined based on a wagering game, specified by a player, etc. For instance, the retrieval request may be generated in response to a player logging into a particular wagering game. The developer of the wagering game may support an online wager gaming community. Hence, the wager gaming community can be determined from the wager game. Furthermore, different or additional data can be used for a retrieval request.

At block 305, the generated retrieval request is transmitted to a server of the online wager gaming community.

At block 307, an entry is created in a wagering game establishment digital representative cache for the player. A player may have multiple digital representatives in different online wager gaming communities. The cache may be associated with player accounts or be separate with an indication of the player and/or reference to a player account record.

At block 309, the created entry is populated with the digital representative data returned for the one or more digital representatives.

Figure 4:
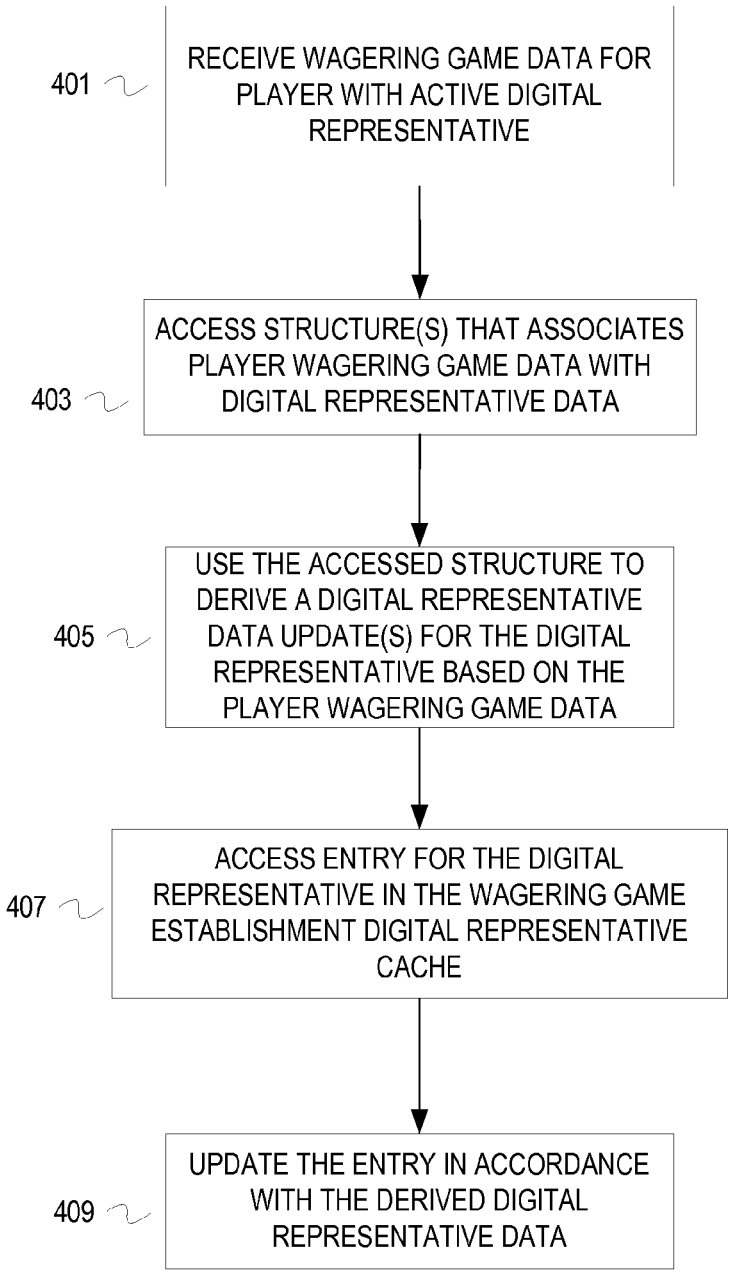
FIG. 4 depicts an example flowchart of operations for updating digital representative data based on wagering game data.

After importing digital representative data, the digital representative data can be updated (e.g., modified, augmented, etc.) based on wagering game activity in the wagering game establishment. FIG. 4 depicts an example flowchart of operations for updating digital representative data based on wagering game data. At block 401, wagering game data for a player with an active digital representative is received. The digital representative is deemed active while employed at a wagering game. The wagering game data for the player may indicate amount won by the player, amount lost, amount wagered, amount of time spent at the electronic wagering game machine, etc.

At block 403, a structure(s) that associates player wagering game data with digital representative data is accessed.

At block 405, the accessed structure is used to derive a digital representative data update(s) for the digital representative based, at least in part, on the player wagering game data. Embodiments can implement the structure(s) differently. For instance, the structure can be indexed by wagering game activity or event codes to lookup reward credits. As an example, the electronic wagering game machine can generate a code that indicates a player hit a particular sequence of tiles. The particular sequence of tiles may not result in a monetary win, but it may be associated with a reward that can be applied to the digital representative (e.g., a particular non-winning sequence can be associated with a new digital hat or a power boost for a digital representative). As another example, an equation can be applied to an amount wagered by a player as reported by an electronic wagering game machine. A process can determine a number of digital representative credits based on the amount wagered (e.g., digital representative credits=amount lost/number of minute spent gaming).

At block 407, an entry for the digital representative in the wagering game establishment digital representative cache is accessed.

At block 409, the entry is updated in accordance with the derived digital representative data update. Updating the entry can involve adding fields, overwriting data, adding a reference to a location (e.g., uniform resource locator), etc.

In addition to generating updates from wagering game activity, wagering game developers can provide games that incorporate digital representatives into interactive scenarios. These games can range from using digital representative data as input into game logic in competitive scenarios to displaying digital representatives and using votes from wagering game establishment patrons for the favorite digital representative. Based on the of the digital representative games, players can win additional plays, free meals, discounted show tickets, rewards for the digital representatives, one or more sweepstakes entries, etc.

Figure 5:
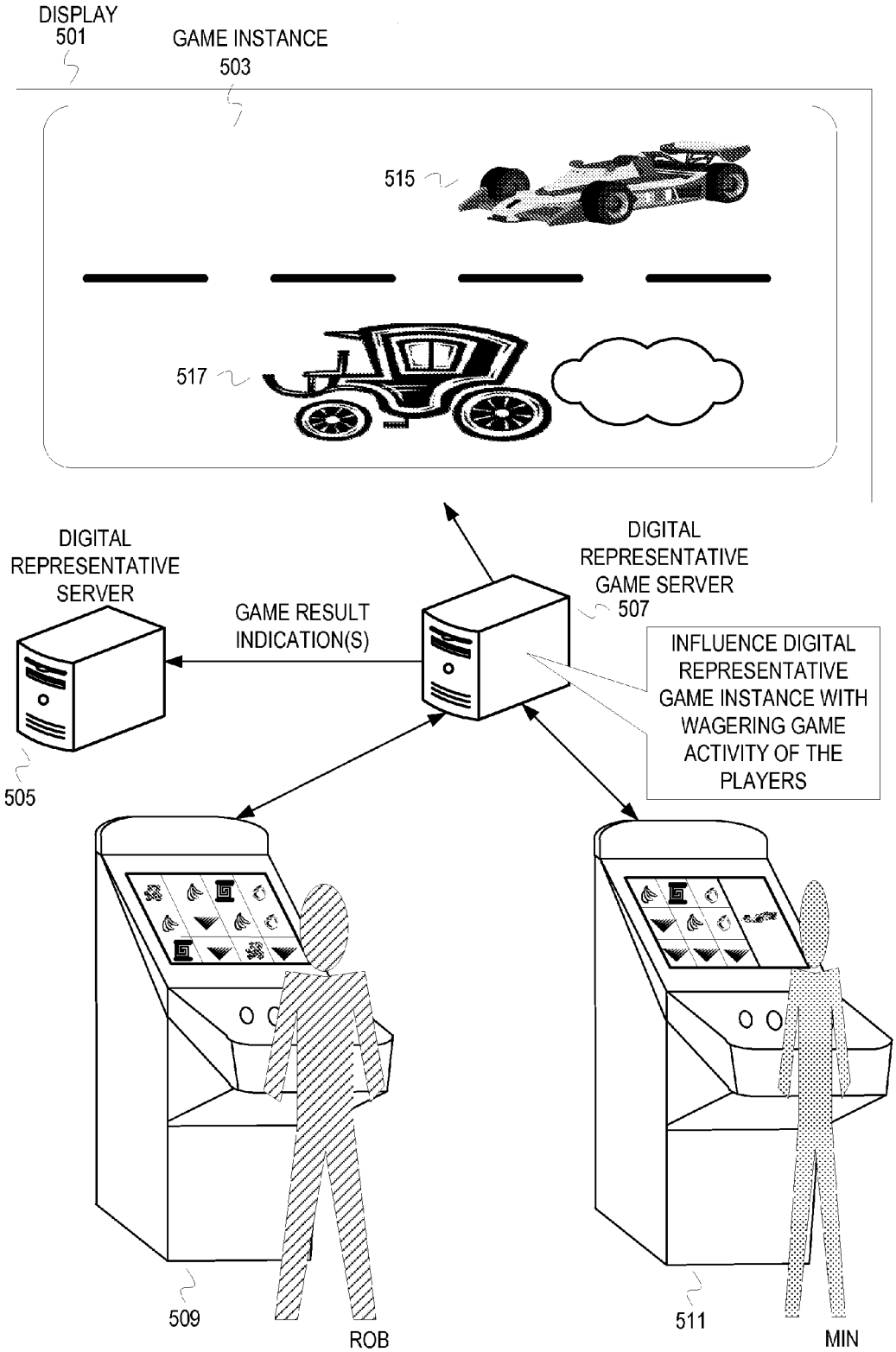
FIG. 5 depicts an example conceptual diagram of a digital representative game instance.

FIG. 5 depicts an example conceptual diagram of a digital representative game instance. A player Rob has a digital representative 517 that is a vintage car. A player Min 511 has a digital representative 515 that is a race car. Players Rob and Min are playing at electronic wagering game machines 509 and 511. A digital representative game server 507 has instantiated a game instance 503 on a display 501. The display 501 displays the digital representatives 515 and 517 competing in a race in the game instance 503. Although the game instance 503 can be driven by static digital representative data, FIG. 5 depicts the game instance 503 being driven by wagering game activity as communicated by the electronic wagering game machines 509 and 511. Hence, the play of Rob and Min influences the game instance 503 in this example.

The electronic wagering game machine 509 and 511 report wagering game activity (e.g., wager amounts, wins, losses, etc.) to the digital representative game server 507. The electronic wagering game machines 509 and 511 can report periodically, in response to requests from the game server 507, in response to certain wagering game activity, etc. The game server 507 then influences the game instance 503 by inputting the wagering game activity or values that correspond to the wagering game activity into logic for the digital representative game. Regardless of appearance, the vintage car digital representative 517 may have been imported with digital representative data that indicates more horsepower than the race car digital representative 515. If the game instance 503 accepts dynamic input of wagering game activity to influence the game instance 503, then Rob's wagering game activity may increase the horsepower value and/or a top speed or decrease the horsepower value and/or top speed of the vintage car digital representative 517.

The game server 507 can use various techniques to translate wagering game activity into input for the game instance logic. For instance, the game server 507 can use an equation to convert amount wagered into acceleration for the game logic. As another example, the game server 507 can lookup an acceleration value based on a wagering game activity code. Embodiments may implement the digital representatives with at least some of the game logic or one or more links to the game logic. For example, the digital representative can perform a lookup or invoke a function to determine an acceleration value based on wagering game activity published by the wagering game server. In addition, digital representative data may be implemented as re-usable, executable code (e.g., widgets), that can have a hierarchical relationship with a digital representative (e.g., nested) as well as with each other. Hence, wagering game activity and/or a resulting digital representative modification can be propagated from the digital representative to subordinates. For example, a wagering game server may publish wagering game activity to a digital representative that causes the digital representative to incorporate code or link to code for a new engine. The new engine affects the code that governs appearance of the digital representative, acceleration of the digital representative, an animation sequence of the digital representative, etc.

After a result for the game instance 503 is generated, the digital representative game server 507 transmits an indication(s) of the result of the game instance 503 to a digital representative server 505. The result indication can indicate the digital representative game, the players, degree of win, achievement in a game that does not provide for an absolute winner, etc. Embodiments can also transmit a result indication(s) to a player account server in addition to or instead of a digital representative server.

Figure 6:
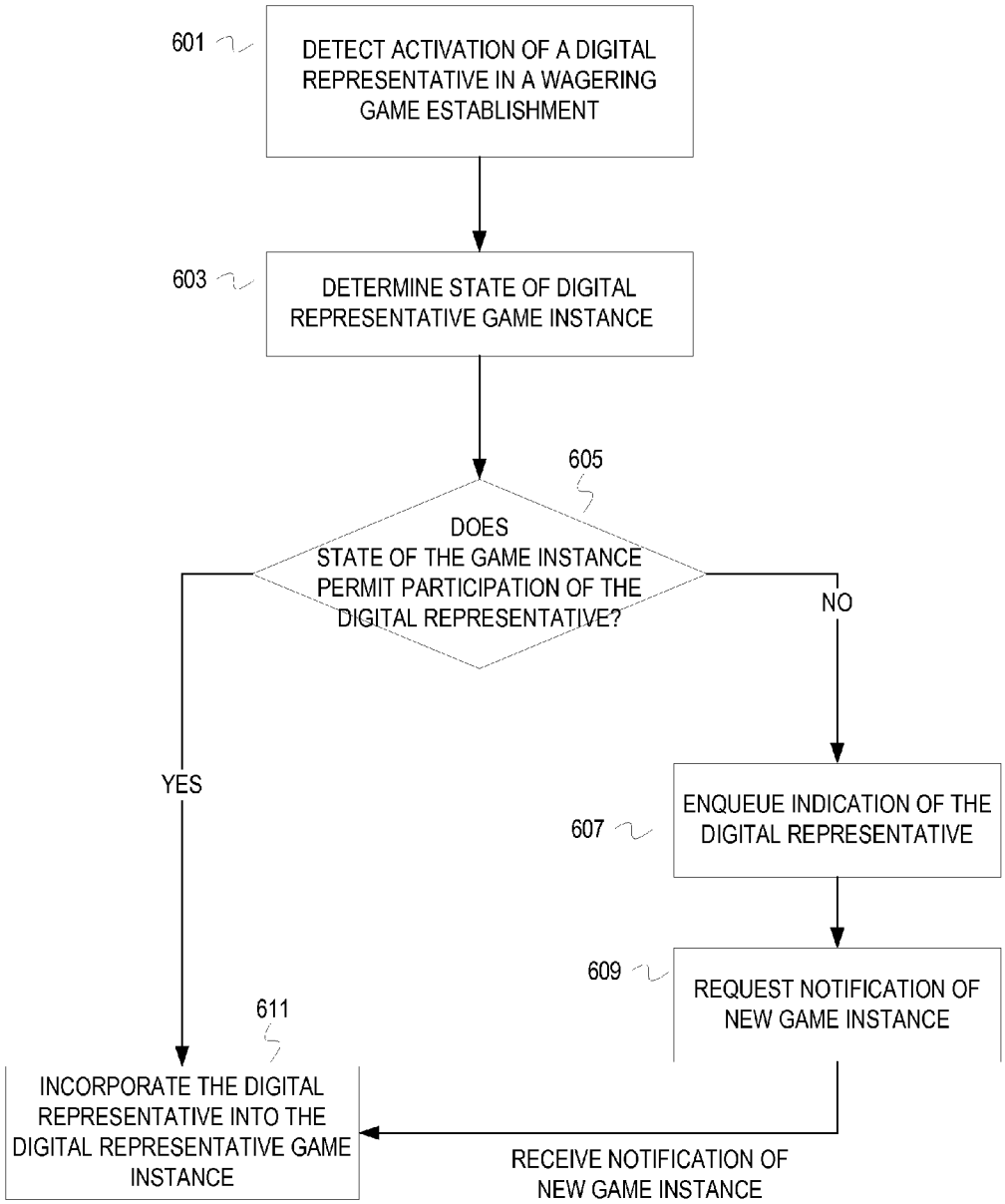
FIG. 6 depicts a flowchart of example operations for enrolling digital representatives into digital representative game instances.

FIG. 6 depicts a flowchart of example operations for enrolling digital representatives into digital representative game instances. At a block 601, activation of a digital representative in a wagering game establishment detected. For example, a user logs into a wagering game and selects one of multiple digital representatives imported for the player.

At block 603, a state of a digital representative game instance is determined. Although some game instances may allow ongoing enrollment of digital representatives, other game instances may have states that would be disrupted by addition of a participant or have multiple states only some of which allow for addition of a participant digital representative.

At block 605, it is determined if the state of the game permits participation of the digital representative. If it is determined that the state of the game permits participation, then control flows to block 611. If it is determined that state of the game does not permit participation, then control flows to block 607.

At block 607, an indication of the digital representative is enqueued. For instance, a process can maintain a queue of pending requests to participate in a game instance.

At block 608, notification of a new game instance is requested. For instance, a process that maintains the queue can subscribe to an event that indicates ending and/or eminent beginning of a game instance. After notification of a new game instance is received, then control flows to block 611.

At block 611, the active digital representative is incorporated into the digital representative game instance.

Figure 7:
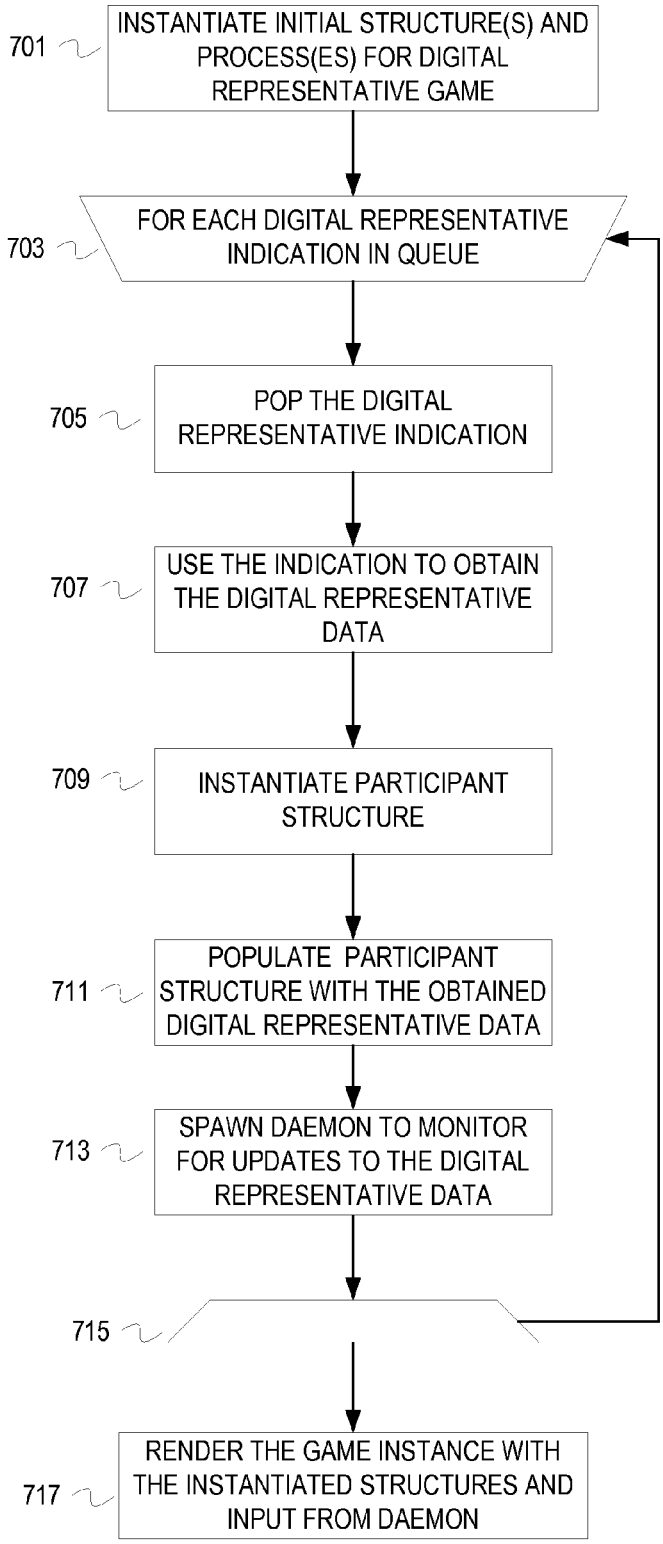
FIG. 7 depicts a flowchart of example operations for instantiating a digital representative game.

FIG. 7 depicts a flowchart of example operations for instantiating a digital representative game. At block 701, an initial structure(s) and process(es) for a digital representative game is instantiated. For example, structure to track game instance progress, and allocated resources are instantiated.

At block 703, a loop begins for each digital representative indication in a queue.

At block 705, the digital representative indication is popped from the queue.

At block 707, the indication is used to obtain digital representative data.

At block 709, a participant structure is instantiated.

At block 711, the instantiated participant structure is populated with the obtained digital representative data. For example, a structure is instantiated and populated with the data for rendering the digital representative and data for attribute or properties of the digital representative that can be relevant to the game instance (e.g., horsepower, agility, speed, etc.).

At block 713, a daemon is spawned to monitor for updates to the digital representative data. For instance, a connection is opened to the electronic wagering game where a player associated with an active participating digital representative is playing. The daemon listens for wagering game activity data that can influence the digital representative game. As another example, a daemon may be spawned to monitor the cache of digital representatives for relevant updates that can be propagated to the game instance. Of course, a daemon is not necessary. Other techniques can be employed to inform the game instance of changes to the digital representative that are relevant to the game instance. For example, the game instance can employ a subscription mechanism for all participating digital representatives.

At block 715, the loop either ends and control flows to block 717 or control flows back to block 705.

At block 717, the game instance is rendered with the instantiated structures and input from the spawned daemon.

Figure 8:
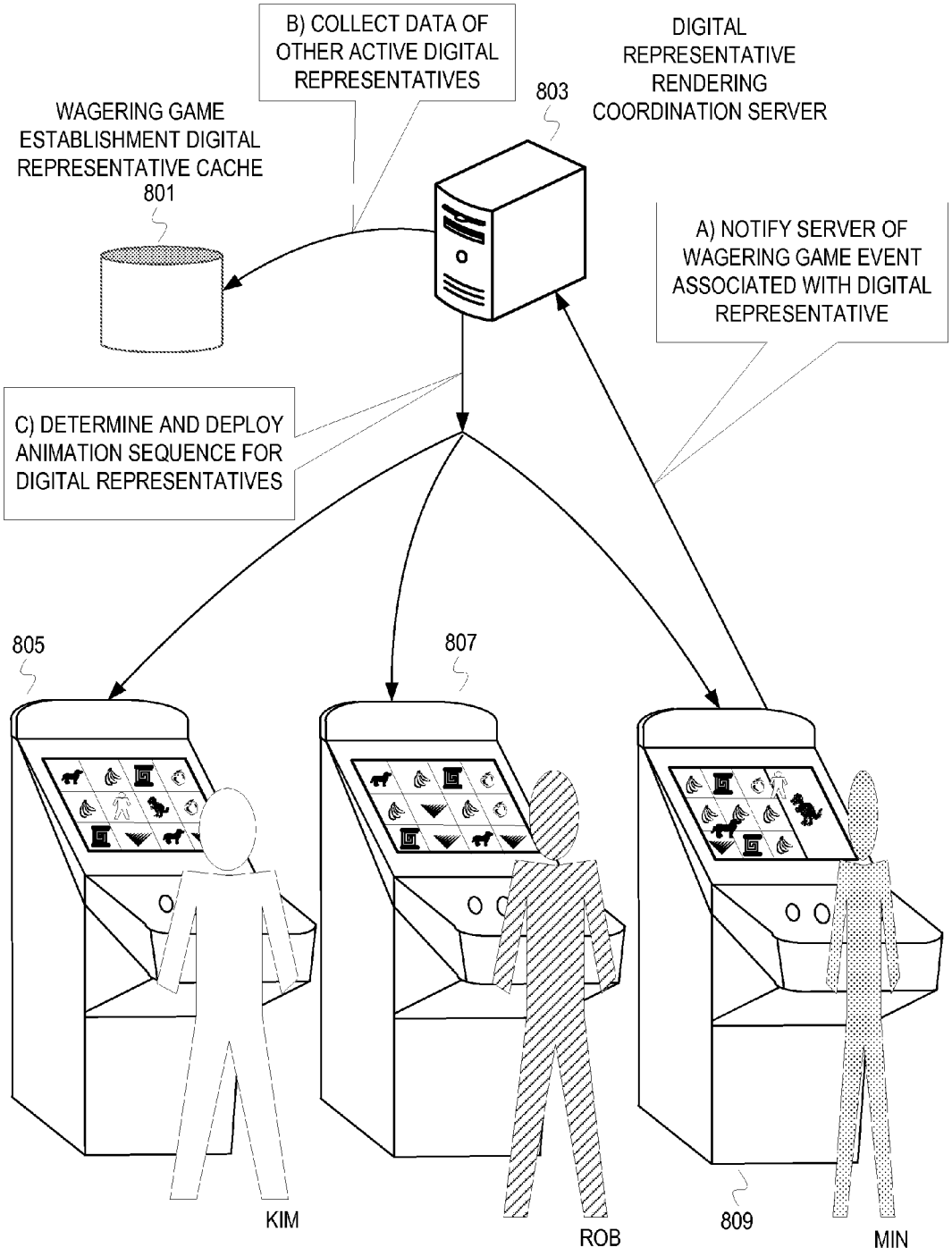
FIG. 8 depicts an example conceptual diagram of using digital representatives for a social wagering game experience.

In addition to enhancing individual gaming experience, digital representatives can also be used to enhance a social aspect of a wager gaming experience. FIG. 8 depicts an example conceptual diagram of using digital representatives for a social wagering game experience. At a stage A, an electronic wagering game machine 809 played by Min notifies a digital representative rendering coordination server 803 of a wagering game event associated with the digital representative of Min. For instance, the electronic wagering game machine 809 notifies the rendering coordination server 803 that Min has hit a jackpot. At a stage B, the rendering coordination server 803 collects data of other active digital representatives from a wagering game establishment digital representative cache 801 For instance, the server 803 queries the cache 801 for active digital representatives with digital representative data that indicates the digital representative of Min or Min as a friend. At a stage C, the server 803 determines an animation sequence for the digital representatives, and deploys the animation sequence. The animation sequence can involve animation of the digital representatives and/or supplemental animation associated with the digital representatives (e.g., balloons to convey messages from the digital representatives). The animation sequence may only involve the electronic wagering game machine 809. For example, the digital representatives of players Kim and Rob (a dog and human avatar in this illustration) may be animated only on the electronic wagering game machine 809 to celebrate Min winning a jackpot.

The server 803 can deploy the same or different animation sequences to other electronic wagering game machines. For example, the server 803 can deploy an animation sequence to an electronic wagering game machine 805, which is being played by Kim, that animates the digital representatives to indicate that Min has won a jackpot. The digital representative of Rob 807 may have digital representative data that indicates more interaction with the digital representative of Min. The server 803 can deploy an animation to the electronic wagering game machine 807, which is being played by Rob, that animates the digital representative of Rob to notify Rob that Min has won a jackpot and for the dog digital representative to rush off screen as if going to the electronic wagering game machine 809.

It should be understood that the depicted flowchart are examples meant to aid in understanding embodiments and should not be used to limit embodiments or limit scope of the claims. Embodiments may perform additional operations, fewer operations, operations in a different order, operations in parallel, and some operations differently. For instance, referring to FIG. 3, additional operations may be performed to determine particular online wager gaming communities indicated in a player's account data. Operations can also be performed to prompt a player to designate or select particular online wager gaming communities and/or wager game developers. Referring to FIG. 6, additional operations may be performed to determine if a digital representative can be directed to a different game instance(s) if state of a first game instance does not permit participation. In addition, game instances can be offered to a player based on characteristics or attributes of the digital representative. For example, the digital representative of a gold player can be rendered with a gold aura to reflect status of the player. A wagering game server(s) can direct digital representatives with the gold aura to particular instances of gold level games. Since previous wagering game activity and achievement, at least partly, determine the digital representative data (e.g., characteristics or attributes), this mechanism allows the dynamic creation of social groups based, at least in part, on similar interest or achievement. Referring to FIG. 7, block 709 may not be performed because the structure of the digital representative can be populated with the obtained digital representative data.

Embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments of the inventive subject matter may take the form of a computer program product embodied in any tangible medium of expression having computer usable program code embodied in the medium. The described embodiments may be provided as a computer program product, or software, that may include a machine-readable medium having stored thereon instructions, which may be used to program a computer system (or other electronic device(s)) to perform a process according to embodiments, whether presently described or not, since every conceivable variation is not enumerated herein. A machine readable medium includes any mechanism for storing or transmitting information in a form (e.g., software, processing application) readable by a machine (e.g., a computer). The machine-readable medium may include, but is not limited to, magnetic storage medium (e.g., floppy diskette); optical storage medium (e.g., CD-ROM); magneto-optical storage medium; read only memory (ROM); random access memory (RAM); erasable programmable memory (e.g., EPROM and EEPROM); flash memory; or other types of medium suitable for storing electronic instructions. In addition, embodiments may be embodied in an electrical, optical, acoustical or other form of propagated signal (e.g., carrier waves, infrared signals, digital signals, etc.), or wireline, wireless, or other communications medium.

Computer program code for carrying out operations of the embodiments may be written in any combination of one or more programming languages, including an object oriented programming language such as Java, Smalltalk, C++ or the like and conventional procedural programming languages, such as the "C" programming language or similar programming languages. The program code may execute entirely on a user's computer, partly on the user's computer, as a standalone software package, partly on the user's computer and partly on a remote computer or entirely on the remote computer or server. In the latter scenario, the remote computer may be connected to the user's computer through any type of network, including a local area network (LAN), a personal area network (PAN), or a wide area network (WAN), or the connection may be made to an external computer (for example, through the Internet using an Internet Service Provider).

Wagering Game Machine Architectures

Figure 9:
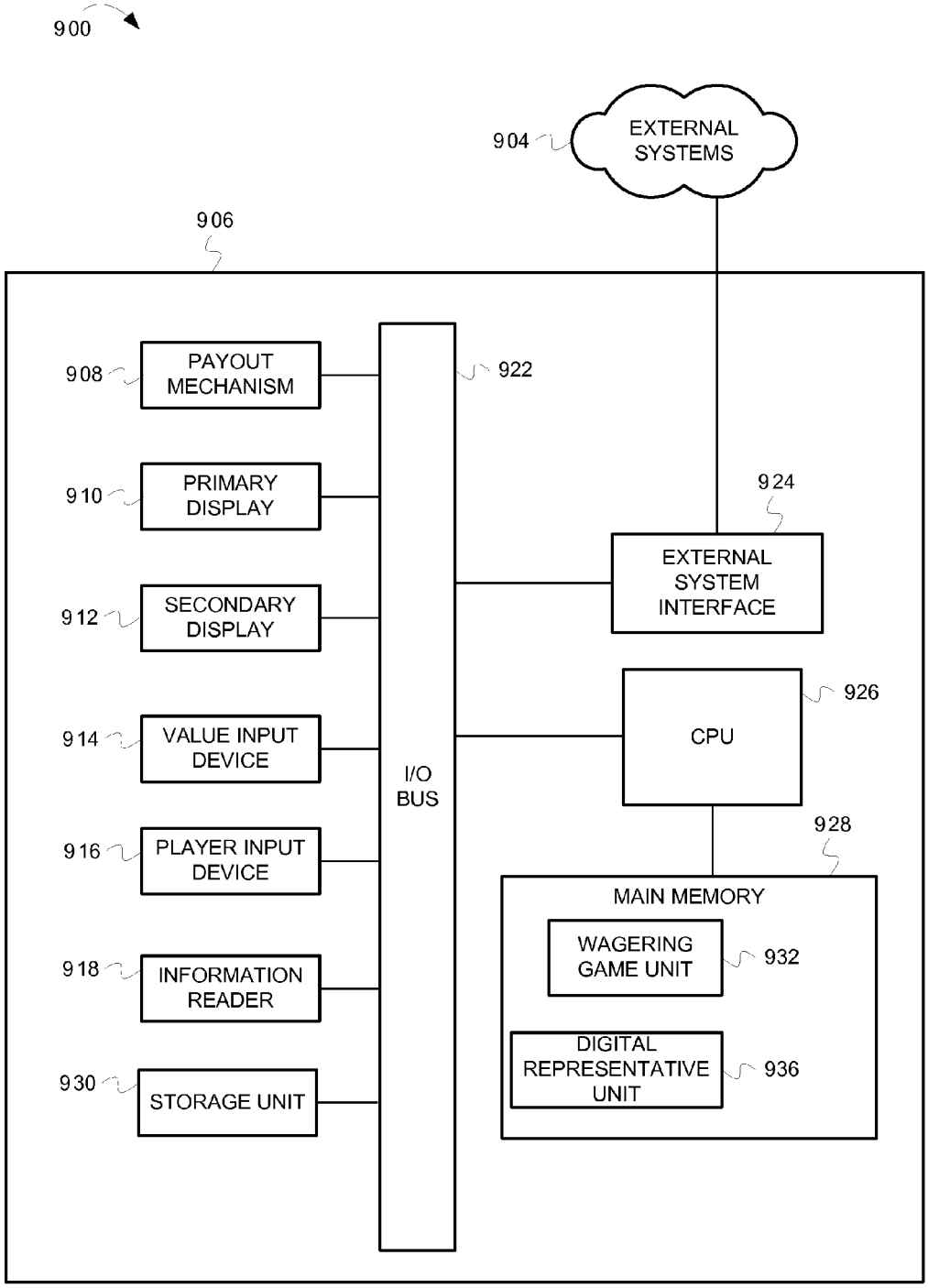
FIG. 9 is a block diagram illustrating a wagering game machine architecture, according to example embodiments of the invention.

FIG. 9 is a block diagram illustrating a wagering game machine architecture, according to example embodiments of the invention. As shown in FIG. 9, the wagering game machine architecture 900 includes a wagering game machine 906, which includes a central processing unit (CPU) 926 connected to main memory 928. The CPU 926 can include any suitable processor, such as an Intel® Pentium processor, Intel® Core 2 Duo processor, AMD Opteron™ processor, or UltraSPARC processor. The main memory 928 includes a wagering game unit 932 and a digital representative unit 936. In one embodiment, the wagering game unit 932 can present wagering games, such as video poker, video black jack, video slots, video lottery, etc., in whole or part. The digital representative unit 936 embodies functionality that allows rendering of digital representatives and communication of wagering game activity that can affect the digital representative to a back-end.

The CPU 926 is also connected to an input/output (I/O) bus 922, which can include any suitable bus technologies, such as an AGTL+ frontside bus and a PCI backside bus. The I/O bus 922 is connected to a payout mechanism 908, primary display 910, secondary display 912, value input device 914, player input device 916, information reader 918, and storage unit 930. The player input device 916 can include the value input device 914 to the extent the player input device 916 is used to place wagers. The I/O bus 922 is also connected to an external system interface 924, which is connected to external systems 904 (e.g., wagering game networks).

In one embodiment, the wagering game machine 906 can include additional peripheral devices and/or more than one of each component shown in FIG. 9. For example, in one embodiment, the wagering game machine 906 can include multiple external system interfaces 924 and/or multiple CPUs 926. In one embodiment, any of the components can be integrated or subdivided.

Any component of the architecture 900 can include hardware, firmware, and/or machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

While FIG. 9 describes an example wagering game machine architecture, this section continues with a discussion wagering game networks.

Wagering Game Networks

Figure 10:
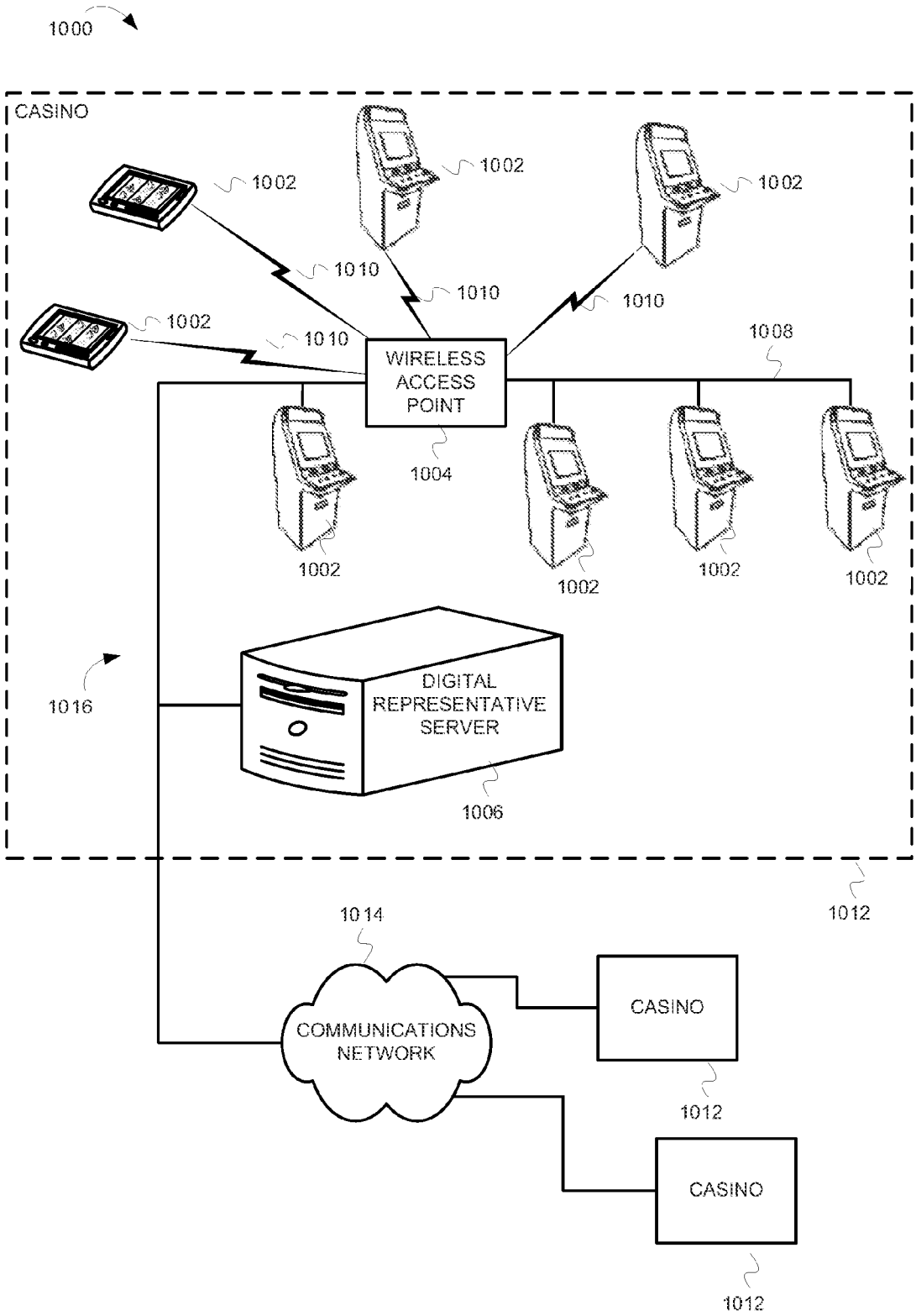
FIG. 10 is a block diagram illustrating a wagering game network 1000, according to example embodiments of the invention.

FIG. 10 is a block diagram illustrating a wagering game network 1000, according to example embodiments of the invention. As shown in FIG. 10, the wagering game network 1000 includes a plurality of casinos 1012 connected to a communications network 1014.

Each casino 1012 includes a local area network 1016, which includes an access point 1004, a wagering game server 1006, and wagering game machines 1002. The access point 10304 provides wireless communication links 1010 and wired communication links 1008. The wired and wireless communication links can employ any suitable connection technology, such as Bluetooth, 802.11, Ethernet, public switched telephone networks, SONET, etc. The wagering game server 1006 can embody functionality of one or both of the example wagering game establishment digital representative server 123 and the digital representative game server 507. In some embodiments, the wagering game server 1006 can serve wagering games and distribute content to devices located in other casinos 1012 or at other locations on the communications network 1014.

The wagering game machines 1002 described herein can take any suitable form, such as floor standing models, handheld mobile units, bartop models, workstation-type console models, etc. Further, the wagering game machines 1002 can be primarily dedicated for use in conducting wagering games, or can include non-dedicated devices, such as mobile phones, personal digital assistants, personal computers, etc. In one embodiment, the wagering game network 1000 can include other network devices, such as accounting servers, wide area progressive servers, player tracking servers, and/or other devices suitable for use in connection with embodiments of the invention.

In some embodiments, wagering game machines 1002 and wagering game servers 1006 work together such that a wagering game machine 1002 can be operated as a thin, thick, or intermediate client. For example, one or more elements of game play may be controlled by the wagering game machine 1002 (client) or the wagering game server 1006 (server). Game play elements can include executable game code, lookup tables, configuration files, game outcome, audio or visual representations of the game, game assets or the like. In a thin-client example, the wagering game server 1006 can perform functions such as determining game outcome or managing assets, while the wagering game machine 1002 can present a graphical representation of such outcome or asset modification to the user (e.g., player). In a thick-client example, the wagering game machines 1002 can determine game outcomes and communicate the outcomes to the wagering game server 1006 for recording or managing a player's account.

In some embodiments, either the wagering game machines 1002 (client) or the wagering game server 1006 can provide functionality that is not directly related to game play. For example, account transactions and account rules may be managed centrally (e.g., by the wagering game server 1006) or locally (e.g., by the wagering game machine 1002). Other functionality not directly related to game play may include power management, presentation of advertising, software or firmware updates, system quality or security checks, etc.

Any of the wagering game network components (e.g., the wagering game machines 1002) can include hardware and machine-readable media including instructions for performing the operations described herein.

GENERAL

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A method comprising:

importing a digital representative of a wagering game player from an online wager gaming community, and data associated with the digital representative responsive to detecting login of the wagering game player, wherein the digital representative comprises first executable code;

determining wagering game activity of the wagering game player at one or more electronic wagering game machines in a wagering game establishment;

responsive to executing the first executable code, determining one or more digital representative data updates for the digital representative based, at least in part, on the determined wagering game activity of the wagering game player;

applying the one or more digital representative updates to the data associated with the digital representative, wherein said applying includes associating a second executable code with the digital representative;

responsive to executing the second executable code, translating the wagering game activity into input for a game instance involving the digital representative; and exporting the digital representative and the updated data associated with the digital representative to the online wager gaming community.

2. The method of claim 1, wherein said digital representative comprises graphical data for rendering the digital representative.

3. The method of claim 1, wherein said applying the one or more digital representative updates to the data associated with the digital representative comprises modifying the data associated with the digital representative to reference a third executable code that implements the one or more digital representative updates, wherein the one or more digital representative updates comprise at least one of reward points, enhancements, and digital representative augmentations.

4. The method of claim 1, wherein said determining the wagering game activity comprises receiving indications of the wagering game activity over a network from the one or more electronic wagering game machines.

5. The method of claim 4 further comprising the digital representative propagating the indications of the wagering game activity to one or more widgets, wherein the one or more widgets are at least one of referenced by the digital representative and nested within the digital representative.

6. The method of claim 1, wherein said data associated with the digital representative comprises data that indicates one or more of attributes, properties, reward points, and enhancements.

7. The method of claim 1, wherein said importing the digital representative of the wagering game player from the online wager gaming community comprises generating a request that indicates the online wager gaming community and the wagering game player, and communicating the request to a server of the online wager gaming community.

8. A method comprising:

instantiating a digital representative game instance that renders interaction among a plurality of digital representatives of wagering game players in a wagering game establishment, wherein the plurality of digital representatives are associated with one or more online wager gaming communities and each of the plurality of digital representative comprises executable code;

monitoring wagering game activity of the wagering game players in the wagering game establishment;

communicating the wagering game activity to executing instances of each of the executable codes of the plurality of digital representatives;

each of the executing instances of the executable codes, translating the wagering game activity into game input for the corresponding digital representative of the plurality of digital representatives;

inputting the game input of each of the plurality of digital representatives into game logic of the digital representative game instance;

influencing the digital representative game instance with the game input; and generating one or more indications of a result of the digital representative game instance for application to data associated with at least a winning one of the plurality of digital representatives.

9. The method of claim 8, wherein said monitoring comprises spawning a process that listens for wagering game activity communications from the plurality of wagering game machines.

10. The method of claim 8, further comprising:

instantiating a second digital representative game instance, wherein the digital representative game instance and the second digital representative game instance are played concurrently;

enrolling a second instance of a first of the plurality of digital representatives into the second digital representative game instance;

applying a first modification to the second instance of the first of the plurality of digital representatives as a result of playing the second digital representative game instance;

applying a second modification to the first of the plurality of digital representatives in the digital representative game instance as a result of playing the digital representative game instance; and maintaining the first of the plurality of digital representatives with the second modification and the second instance of the first of the plurality of digital representatives with the first modification for a first of the wagering game players with an account associated with the first of the plurality of digital representatives.

11. The method of claim 8, wherein said translating the wagering game activity into game input for the corresponding digital representative of the plurality of digital representatives comprises at least one of deriving the game input from evaluating an expression associated with the digital representative and the wagering game activity and looking up the game input within a data structure associated with the digital representative based, at least in part, on the wagering game activity.

12. One or more non-transitory machine-readable storage media encoded with instructions, which when executed by a set of one or more processors, causes the set of one or more processors to perform operations that comprise:

importing a digital representative of a wagering game player from an online wager gaming community, and data associated with the digital representative responsive to detecting login of the wagering game player, wherein the digital representative comprises first executable code;

determining wagering game activity of the wagering game player at one or more electronic wagering game machines in a wagering game establishment;

responsive to executing the first executable code, determining one or more digital representative data updates for the digital representative based, at least in part, on the determined wagering game activity of the wagering game player;

applying the one or more digital representative updates to the data associated with the digital representative, wherein said applying includes associating a second executable code with the digital representative;

responsive to executing the second executable code, translating the wagering game activity into input for a game instance involving the digital representative; and exporting the digital representative and the updated data associated with the digital representative to the online wager gaming community.

13. The non-transitory machine-readable media of claim 12, wherein said digital representative comprises graphical data for rendering the digital representative.

14. The non-transitory machine-readable media of claim 12, wherein said data associated with the digital representative comprises data that indicates one or more of attributes, properties, reward points, and enhancements.

15. The non-transitory machine-readable media of claim 12, wherein the wherein said operation of importing the digital representative of the wagering game player from the online wager gaming community comprises generating a request that indicates the online wager gaming community and the wagering game player, and communicating the request to a server of the online wager gaming community.

16. One or more non-transitory machine-readable storage media encoded with instructions, which when executed by a set of one or more processors, causes the set of one or more processors to perform operations that comprise:

instantiating a digital representative game instance that renders interaction among a plurality of digital representatives of wagering game players in a wagering game establishment, wherein the plurality of digital representatives are associated with one or more online wager gaming communities and each of the plurality of digital representative comprises executable code;

monitoring wagering game activity of the wagering game players in the wagering game establishment;

communicating the wagering game activity to executing instances of each of the executable codes of the plurality of digital representatives;

each of the executing instances of the executable codes, translating the wagering game activity into game input for the corresponding digital representative of the plurality of digital representatives;

inputting the game input of each of the plurality of digital representatives into game logic of the digital representative game instance;

influencing the digital representative game instance with the game input; and generating one or more indications of a result of the digital representative game instance for application to data associated with at least a winning one of the plurality of digital representatives.

17. The non-transitory machine-readable media of claim 16, wherein said monitoring operation comprises spawning a process that listens for wagering game activity communications from the plurality of wagering game machines.

18. The non-transitory machine-readable media of claim 16, wherein said operation of translating the wagering game activity into game input for the corresponding digital representative of the plurality of digital representatives comprises at least one of deriving the game input from evaluating an expression associated with the digital representative and the wagering game activity and looking up the game input within a data structure associated with the digital representative based, at least in part, on the wagering game activity.

19. An apparatus comprising:

a network interface;

means for obtaining a digital representative of a wagering game player from an online wager gaming community, and data associated with the digital representative;

means for modifying the data associated with the digital representative based, at least in part, on wagering game activity of the wagering game player in a wagering game establishment;

means for translating the wagering game activity into game input for a game instance involving the digital representative responsive to executing executable code embedded in the digital representative; and means for exporting the digital representative with the modified data to the online wager gaming community.

20. The apparatus of claim 19 further comprising means for instantiating the game instance that incorporates digital representatives and wagering game activity of players associated with the digital representatives responsive to detecting the wagering game activity.

21. An apparatus comprising:

a set of one or more processors;

a network interface;

a digital representative importer operable to import a digital representative of a wagering game player from an online wager gaming community, and data associated with the digital representative responsive to detecting login of the wagering game player, wherein the digital representative comprises first executable code;

a digital representative modifier operable to, determine wagering game activity of the wagering game player at one or more electronic wagering game machines in a wagering game establishment;

responsive to executing the first executable code, determine one or more digital representative data updates for the digital representative based, at least in part, on the determined wagering game activity of the wagering game player;

apply the one or more digital representative updates to the data associated with the digital representative, wherein the digital representative modifier being operable to apply the one or more digital representative updates includes the digital representative modifier being operable to associate a second executable code with the digital representative;

responsive to executing the second executable code, translate the wagering game activity into input for a game instance involving the digital representative; and a digital representative exporter operable to, export the digital representative and the updated data associated with the digital representative to the online wager gaming community.

22. The apparatus of claim 21, wherein a machine-readable storage medium embodies the digital representative modifier, and the digital representative modifier is operable via the set of one or more processors.

* * * * *